US006012360A

United States Patent [19]

Concha

[11] Patent Number: 6,012,360

[45] Date of Patent: Jan. 11, 2000

[54] HYDRAULIC WRENCH WITH GRIPPING FORCE PROPORTIONAL TO APPLIED TORQUE

[75] Inventor: Raul Alejandro Barria Concha, Temuco, Chile

[73] Assignee: Olaya Saavedra Santana, Temuca, Chile

[21] Appl. No.: 09/114,722

[22] Filed: Jul. 13, 1998

[51] Int. Cl.[7] ..... B25B 13/50

[52] U.S. Cl. ..... 81/57.39; 81/57.33; 81/57.44

[58] Field of Search ..... 81/57.33, 57.34, 81/57.39, 57.42, 57.44

[56] References Cited

U.S. PATENT DOCUMENTS

| | | | |
|---|---|---|---|
| 2,823,450 | 2/1958 | Thomas | 81/57.44 X |
| 3,500,708 | 3/1970 | Wilson | 81/57.34 |
| 4,194,419 | 3/1980 | Mitchhart et al. | 81/57.33 |
| 4,916,986 | 4/1990 | Junkers | 81/57.39 |
| 5,791,206 | 8/1998 | Daigle et al. | 81/57.33 |

*Primary Examiner*—David A. Scherbel
*Assistant Examiner*—Anthony Ojini
*Attorney, Agent, or Firm*—Schweitzer Cornman Gross & Bondell LLP

[57] ABSTRACT

A hydraulic wrench for loosening large diameter threaded components has a swing body pivotally attached to a base, a clamp support, a lever and a hydraulic cylinder. The clamp support is slidably mounted on the swinging body, and a spring (or passive hydraulic cylinder) biases the clamp support into a rest position with respect to the swinging body. The lever is pivotally mounted to the clamp support and a spring biases the lever into an open position with respect to the clamp support. The hydraulic cylinder is pivotally connected to the lever and provides both gripping force and rotational torque to the subject threaded component. The gripping force applied is thus always proportional to the torque.

8 Claims, 1 Drawing Sheet

HYDRAULIC WRENCH WITH GRIPPING FORCE PROPORTIONAL TO APPLIED TORQUE

FIELD OF THE INVENTION

The application field is the loosening of threaded joints, and in particular joints of large diameter round components, usually over 150 mm, such as those found in the drill rigs of the mining industry.

BACKGROUND AND SUMMARY OF THE INVENTION

In the mining industry, blast holes are typically made with large diameter drilling equipment. The components of the drill rig are threaded and screwed together to transmit the force and the torque applied to the drill bit. During the drilling operation, intense dynamic effects are produced, with heavy shocks and vibrations that cause the threaded joint to stick. The situation worsens when the threads are damaged, or when the drill rig is used for long periods without disassembling.

The drilling equipment is typically fitted with hydraulic devices to loosen stuck joints, commonly known as breakout wrenches or chain wrenches. When they do not operate properly, the drilling is delayed, and several people with appropriate equipment have to work hard to loosen the joint, with significant risk for both people and equipment.

The typical cause of failure of the developed wrenches is insufficient gripping or dragging force between the clamps and the part being loosened, when the required loosening torque is high. This is due to the fact that the gripping force of the wrench over the piece is relatively constant, while the loosening torque varies from zero in the initial moment, up to the maximum value when the joint breaks. If the maximum required torque is higher than the torque allowed by the gripping force, the wrench slips over the stem and the operation has to be stopped.

To solve the problem, rig workers can apply heat to expand the part that has to be loosened, and deposit some bead welding to improve the dragging of the wrench, and then try again. The problem is often exacerbated when the stem is worn from use and thus has a reduced outside diameter.

In the search to solve the problem, it has been found, surprisingly, that when the gripping force increases with the applied torque, the slipping is substantially eliminated.

In a preferred embodiment of the present invention, the increase of the gripping force with the applied torque is achieved through a wrench where both the required torque and the gripping force of the clamps are produced simultaneously by the same hydraulic cylinder. This is attained by arranging the hydraulic cylinder in such a way as to produce the loosening torque through a lever that also generates the application force of the clamps. This effect is reinforced by the clamp design, which facilitates inlaying in the stem material to further reduce any slipping possibility.

In the case of a strongly stuck joint that requires a high loosening torque, the gripping force of the clamps over the component is equally high, with inlaying in the component, thereby allowing the hydraulic cylinder to be charged with a high pressure, if required, without slipping.

With this novel design we get in addition a great capacity to accommodate stems or components with different wear and different diameters, without any requirement of special adjustments. Thus, the wrench can be used with new stems, or with completely worn ones, with the smallest operating diameter, without any adjustment.

DETAILED DESCRIPTION OF THE INVENTION

Figure 1:
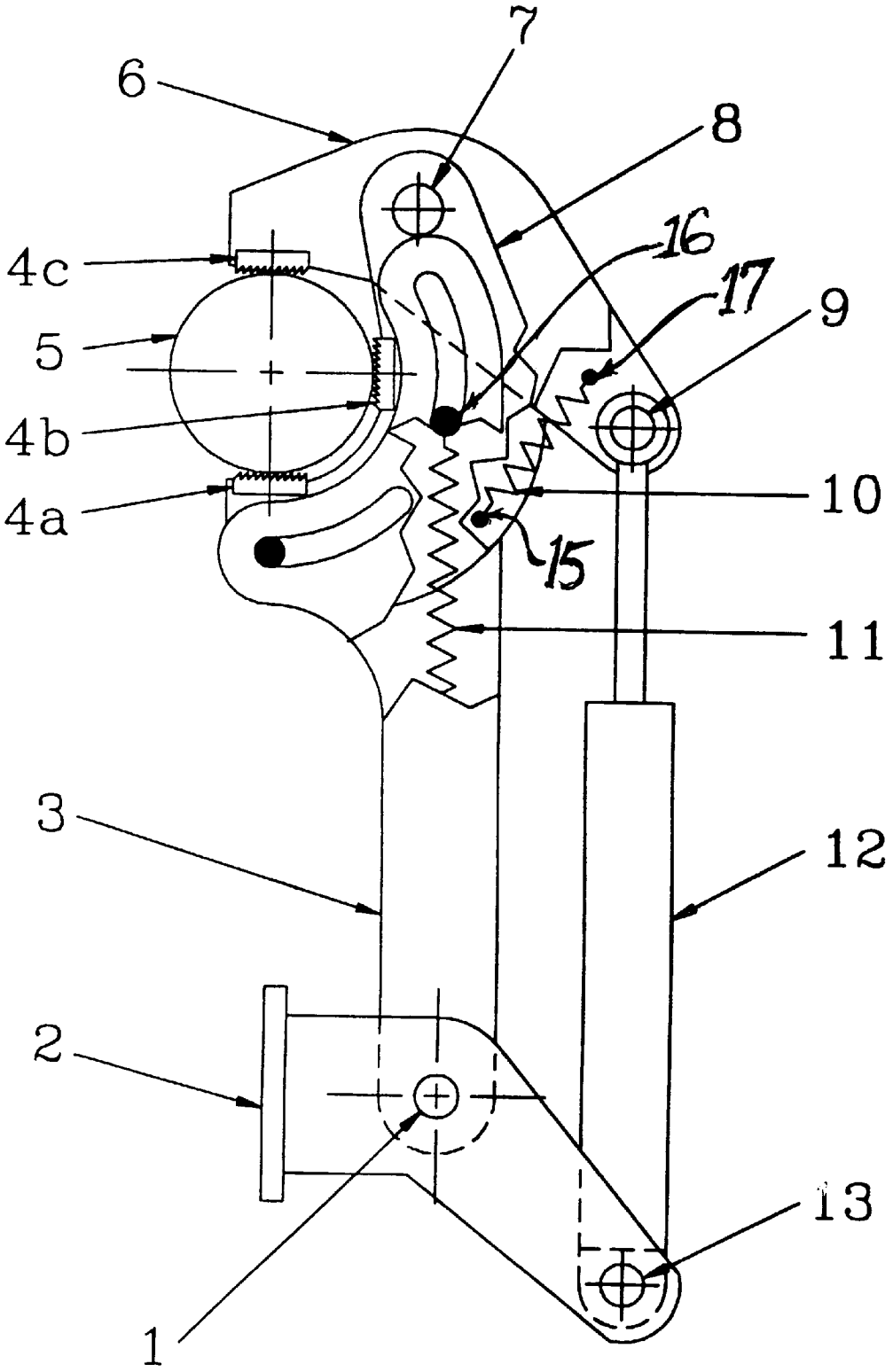
FIG. 1 is a top plan view of the invention.

Referring to FIG. 1, the wrench includes a connection base 2 to anchor the wrench to the drilling equipment. The base 2 holds pivoting pins 1 and 13 of a principal swinging body 3, and of a hydraulic cylinder 12, respectively.

The principal swinging body 3 includes fixing and guiding elements 14 of a semi-fixed clamp support 8. The principal swinging body 3 also holds one end point (hidden) of a first biasing spring or passive hydraulic cylinder 11, for the initial pressing of the clamps.

The semi-fixed clamp support 8 mounts clamps 4*a*, 4*b* and is connected by a pivoting pin 7 to a lever 6. The clamp support 8 is connected to one end 15 of a second biasing spring 10, and a second end 16 of the first biasing spring or passive hydraulic cylinder 11. This support 8 rotates together with the piece 5 that is being loosened at the moment the joint is freed.

The lever 6 includes the movable clamp 4*c*, and is connected by the pivoting pin 7 to the semi-fixed clamp support 8, and by a pivoting pin 9 to the piston rod of hydraulic cylinder 12. The lever 6 is also connected to the other end 17 of the second biasing spring 10.

The position shown in FIG. 1 corresponds to the wrench applied over the stem 5, with the cylinder 12 partially extended, and prior to loosening the joint. The operation of the mechanism will be explained beginning with the retraction movement of the wrench to its parked position when it is not in use.

This action takes place by the retraction movement of the cylinder 12 piston rod, that opens the clamp 4*c*, by pivoting the lever 6 with respect to the pin 7. This opening movement releases the pressure on the semi-fixed clamp support 8, allowing the retraction of the wrench to its parked position, with a swing between 45 and 90 degrees to the right, as the cylinder 12 finishes its closing stroke.

The application of the wrench to loosen a joint begins with the feeding of pressurized oil to the hydraulic cylinder 12, to extend its piston rod. The movement of the piston rod is applied to the lever 6 that initially remains stationary with respect to its pivoting pin 7, due to the force opposed by the second biasing spring 10. This causes the swinging of the whole wrench body 3 to the left, with the clamps open, until the semi-fixed clamps 4*a*, 4*b* make contact with the component to be loosened 5. Preferably, the second biasing spring 10 is pre-loaded to between 250 and 300 kg.

As the extension of the cylinder 12 piston rod continues, the lever 6 pivots about the pin 7, extending the spring 10, closing the clamps 4*a*, 4*b* and 4*c* over the stem 5. From this position, any increasing of the oil pressure fed to the cylinder 12, produces an increasing gripping force in the clamps 4*a*–4*c*. Due to the action of the lever 6, we have at the same time an increasing torque over the semi-fixed clamp support 8, in the loosening direction of turn.

The clamp support 8 remains stationary until the torque applied by the lever 6 is high enough to extend the first biasing spring or hydraulic cylinder 11. Thus, an initial clamping force is always established before the beginning of the turning movement, and is preferably between 2,000 and 3,000 kg.

The force and torque developed will continue increasing as the oil pressure fed to the cylinder 12 is higher and higher, until the joint breaks free and the stem 5, strongly fastened by the clamps 4, begins to rotate. This rotation is guided by grooves 14 made in the swinging body 3.

The possibility of the wrench slipping is minimized because the gripping force applied to the stem 5 increases proportionally to the increasing torque applied by the wrench.

The invention also minimizes the effects of stem wear, which can reduce the stem diameter and cause slipping of the traditional wrenches. However, wear does not have a major influence with the invention, because it is compensated for by a slight increase in the swing of the lever 6, until the clamps 4*a*–4*c* make contact with this reduced diameter. Thereafter the application of the loosening torque begins in the same way as described, after extending the pre-loaded biasing spring 11, or the force of the passive hydraulic cylinder in that position. This produces a clamping force over the stem very similar to the unworn condition.

I claim:

1. A hydraulic wrench for loosening a screw joint between two threaded components, comprising:

a base;

a swinging body pivotally mounted to said base;

a clamp support movably connected to said swinging body, said clamp support having at least one clamp for gripping one of said threaded components;

a lever pivotally attached to said clamp support, said lever having a clamp for gripping said one threaded component;

a first means to bias said clamp support toward a retracted position with respect to said swinging body;

a second means to bias said lever toward an open position with respect to said clamp support;

a hydraulic cylinder having a first end connected to said base and a second end connected to said lever;

said hydraulic cylinder simultaneously producing gripping force on and torque to one of the threaded components, said gripping force varying proportionally with the torque.

2. A hydraulic wrench as in claim 1, wherein said first biasing means is connected between said clamp support and said swing body, and substantially prevents the movement of said clamp support with respect to said swinging body until a predetermined magnitude of said gripping force is attained.

3. A hydraulic wrench as in claim 2, wherein said predetermined gripping force is between about 2,000 and about 3,000 kg, to produce an initial gripping force sufficiently high to avoid slipping of the wrench.

4. A hydraulic wrench as in claim 1, wherein said second biasing means is connected between said lever and said clamp support and maintains said lever in a substantially open position while said swinging body pivots with respect to said base.

5. A hydraulic wrench as in claim 4, wherein said second biasing means is pre-loaded between 250 and 300 kg, in order to maintain the clamps open, while the wrench turns to its operating position.

6. The hydraulic wrench of claim 1, further comprising means to limit the relative motion of said clamp support with respect to said swinging body along a substantially arcuate path.

7. The hydraulic wrench of claim 1 wherein said hydraulic cylinder is the sole means to actuate the wrench.

8. The hydraulic wrench of 1 wherein:

(a) said screw joint has a center, said center of said screw joint and a point at which said hydraulic cylinder is pivotally connected to said base forming a line;

(b) said swing body is pivotally mounted to said base at a point offset from said line in a first direction; and (c) said lever is pivotally connected to said hydraulic cylinder at a point offset from said line in a second direction.

* * * * *